US006526679B1

(12) United States Patent
Wood

(10) Patent No.: US 6,526,679 B1
(45) Date of Patent: Mar. 4, 2003

(54) MOUNTING DEVICE FOR COMMENDATION BARS

(76) Inventor: Timothy P. Wood, 5979 Bacon Ave. E., Inver Grove Heights, MN (US) 55077

( * ) Notice: Subject to any disclaimer, the term of this patent is extended or adjusted under 35 U.S.C. 154(b) by 0 days.

(21) Appl. No.: 09/991,803

(22) Filed: Nov. 19, 2001

(51) Int. Cl.[7] ..... A44C 3/00
(52) U.S. Cl. ..... 40/1.5; 40/668
(58) Field of Search ..... 40/1.5, 1.6, 668; 63/20; 24/13, 706.2, 706.3

(56) References Cited

U.S. PATENT DOCUMENTS

| | | | | | |
|---|---|---|---|---|---|
| 821,547 | A | * | 5/1906 | Stafford | 40/1.5 |
| 2,336,184 | A | * | 12/1943 | Mitchel | 40/1.5 |
| 2,495,577 | A | | 1/1950 | Elkies | |
| 2,707,344 | A | | 5/1955 | Bolognese | |
| 2,832,161 | A | | 4/1958 | Murphy | |
| 2,834,129 | A | * | 5/1958 | Kirkbride | 40/1.5 |
| 2,859,500 | A | * | 11/1958 | Neyret | 24/13 |
| 3,192,655 | A | | 7/1965 | Harn | |
| 3,193,956 | A | | 7/1965 | Przybysiski | |
| 3,455,042 | A | | 7/1969 | Carr et al. | |
| 3,579,881 | A | | 5/1971 | Cherry | |
| 3,942,273 | A | | 3/1976 | Adams | |
| 4,137,657 | A | | 2/1979 | Wardle | |
| 4,989,352 | A | * | 2/1991 | Seppanen | 40/1.5 |
| 6,122,805 | A | | 9/2000 | Haegley | |
| 6,185,848 | B1 | * | 2/2001 | Chmiel | 40/1.5 |

* cited by examiner

*Primary Examiner*—Brian K. Green
(74) *Attorney, Agent, or Firm*—Nikolai & Mersereau, P.A.

(57) ABSTRACT

A commendation bar mounting device for uniforms of the type worn by police officers, firefighters and like persons. The commendation bars are generally rectangular and have rearwardly projecting pins. The mounting plate is designed to mate with commendation bars by inserting the pins into openings on the mounting plate and bending at least one of the pins back into the opening of the mounting plate and attaching the commendation bars onto the plate using an adhesive. A forwardly projecting flange surrounds the plate framing the outer walls of the commendation bars, the inner walls of the commendation bars abut other commendation bars to prevent slippage on the uniform. At least two pins on the commendation bars are left protruding from the back of the mounting plate to penetrate the uniform. The pins are then received by a cooperating releasable clasp to hold the mounting device on the uniform.

2 Claims, 3 Drawing Sheets

MOUNTING DEVICE FOR COMMENDATION BARS

BACKGROUND OF THE INVENTION

I. Field of the Invention

This invention related to a frame for holding one or more commendation bars and for mounting the commendation bars to a uniform. More specifically, this invention provides frames to which metal bar type awards can be secured so that each of the awards need not be separately secured to the uniform.

Police officers, firefighters and military personnel receive badges and awards for service above and beyond the call of duty. These badges are to be worn on the uniform in a systematic, neat, and orderly manner. These badges and awards can be made of metal. Metal pins and badges typically have one or more pins projecting from the back which pierce the uniform and are used along with a releasable clasp to secure the badge to the uniform. The badges must be removed from the uniform when the uniform needs to be cleaned and pressed. Once the uniform is cleaned and pressed, the badges must be neatly reattached to the uniform.

When the officer receives several such badges, removal and replacement of the badges can be a time-consuming or cumbersome task. Because the awards need to be neatly placed to meet codes and guidelines related to proper uniform attire, placement of the badges in compliance with such guidelines is difficult to accomplish by eyesight alone.

II. Related Art

Others have tried to make the placement of badges on a uniform an easier and less time consuming task. For example, U.S. Pat. No. 2,495,577 granted on Jul. 3, 1946 to H. Elkies discloses an apparatus to which a plurality of commendation bars can be attached. The apparatus is then attached to the uniform to hold the commendation bars in place. The apparatus has a bar to which the commendation bars are attached. Each bar has a pair of forwardly diverging flanges. The commendation bars have rearwardly converging flanges which embrace the forwardly diverging flanges on the bar to secure the commendation bar to the bar. This approach has two problems. First, the commendation bars are free to slide from their left to their right, and are only held by small tongues on the left and right sides of the bar. The '577 patent does not provide a frame surrounding the commendation bars to prevent the commendation bars from sliding off the bars. Second, the bar only accommodates one horizontal row or commendation bars. As the officer earns additional commendation bars, it may be necessary to provide a second row, and the Elkies design does not provide for expansion to a second row of commendation bars. This may result in unsightly gaps between the rows of commendation bars, as each commendation bar is applied separately. Further, the commendation bars must be provided with flanges that mesh with the flanges of the bar. The Elkies apparatus will not work with commendation bars or badges having pins for securing commendation bars to the uniform.

To resolve the need for multiple rows of bars, U.S. Pat. No. 2,832,161 granted on Apr. 29, 1958 to J. A. Murphy, discloses a plurality of uniformly spaced parallel bars for receiving commendation bars. Each bar has flanges which cooperate with flanges on the commendation bar. The Murphy apparatus is mounted to the uniform using screws that penetrate the uniform, and nuts secure the commendation bar holder to the uniform. It is time consuming for officers to line up the screws on the uniform and then attach them to the commendation bar holder. The '161 patent does not provide a frame surrounding the commendation bars so, as in Elkies, the commendation bars sometimes slip laterally. Also, like Elkies, the Murphy patent does not teach a device for holding commendation bars or badges that use pins rather then flanges for securing the commendation bar to the uniform.

Some prior art devices do not use mating inwardly and outwardly extending flanges to hold the commendation bars. An example of such a device is U.S. Pat. No. 4,137,657 granted on Feb. 6, 1979 to P. Wardle entitled "Shield and Award Designation Mounting Device." In the '657 patent, award bars are attached to individual mounting devices for each award. The device, however, only accommodates award bars that have lugs on the backside. It is not designed to accommodate pins. Further, it does not provide a framing system to prevent the award bars from sliding on the officer's uniform.

Some recent inventions represent attempts to accommodate commendation bars that are secured using rearwardly protruding pins. U.S. Pat. No. 6,122,805 granted on Sep. 26, 2000 to D. Haegley entitled "Device For Securing Ribbons to Military Uniform" merely calls out a plastic backing which receives the pins on the inside of the uniform to prevent scratching. This method creates alignment problems because the user must align the commendation bars by eyesight alone. It does not provide a plate with openings to assist in the orderly alignment of the commendation bars. Further, it does not provide a frame to prevent the slipping of the commendation bars on the uniform. The Haegley device solves the problem of pin exposure, but does not assist in the orderly alignment of the commendation bars.

Presently, existing holders and clasps designed to fix such awards to the officer's uniform do not provide a complete frame for the awards. Without edging on the frame to assist in the alignment of the awards, the awards may tip or slide off of the holder or clasp. This makes the uniform appear sloppy.

SUMMARY OF THE INVENTION

A primary object of the present invention is to provide a frame for holding a plurality of commendation bars and for securing the frame to a uniform.

Another object of the invention is provide such a frame which holds the commendation bars in a secure fashion so they will not fall off of shift either up or down or side to side.

Still another object of the invention is to provide a frame which is capable of holding in a secure fashion commendation bars that have one or more pins affixed to and projecting from the backside of the commendation bar.

A further object of the invention is to provide a frame that can hold commendation bars that do not have flanges.

These and other objects of the invention are achieved by providing a frame having a back, a peripheral wall projecting forwardly from the back, and a series of pin securing openings in the back. When the frame is used, the commendation bars are secured to the frame by gluing the commendation bars to the frame and inserting the pins of the commendation bars through the openings in the frame and then bending the pins on the commendation bars—with the exception of the one or two of the pins. The commendation bars are thus held to the frame. The peripheral wall prevents the badges from moving up or down or side to side in the frames. The frame is then preferably attached to the uniform by causing the two pins that have not been bent over to penetrate the uniform. These pins are then mated with a releasable clasp to secure the frame and the commendation bars in place on the uniform.

The present invention overcomes all of the disadvantages discussed above by providing a set of frames that can be used for easily securing, aligning, and removing commendation bars on a uniform. The frames of the present invention are particularly useful for performing these tasks for commendation bars having a pin or pair of pins projecting rearwardly from the back.

DETAILED DESCRIPTION OF THE INVENTION

Referring specifically to the drawings, the numeral 1 generally designates the present invention, which is a device mounted on either a shirt or jacket of a police officer's uniform 8.

Figure 2:
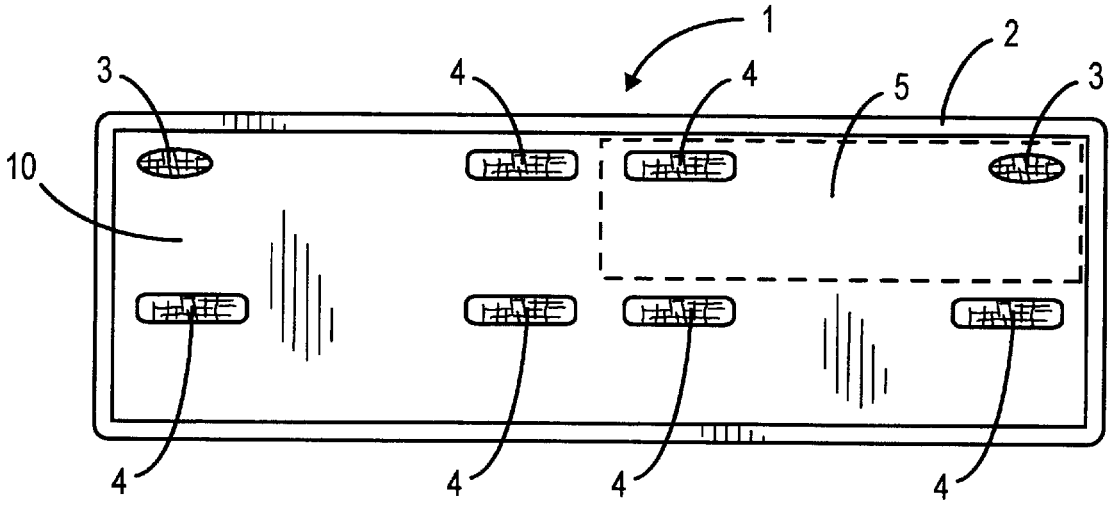
FIG. 2 is a front plain view of the frame with one commendation bar mounted on the frame.
Figure 3:
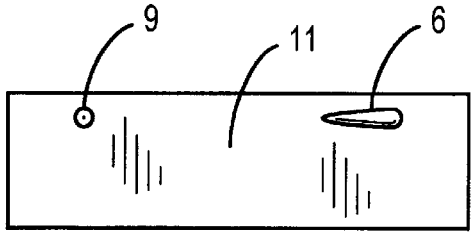
FIG. 3 is a view of the backside of the commendation bar showing the bending of the pins to accommodate the openings on the mounting device.

FIG. 2 shows the front of the mounting device 1. The mounting device has a substantially flat plate 10 which is preferably a hard surface. Projecting forward along the peripheral edges of the flat plate 10 is a sidewall 2. The mounting device is sized and shaped to receive a specific number of commendation bars 5. The sidewall 2 prevents the commendation bars 5 from moving up or down, moving from side to side, or tilting.

Figure 1:
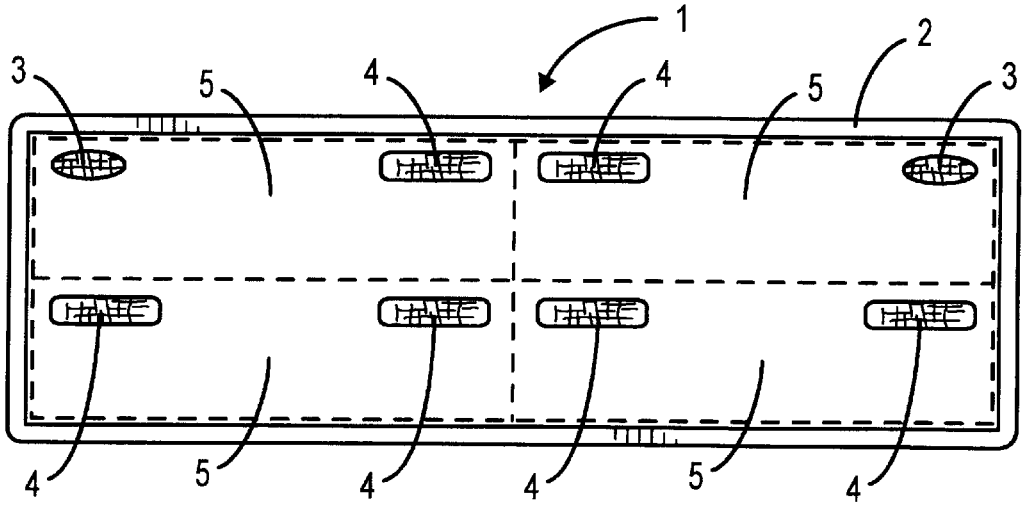
FIG. 1 is a front plain view showing two rows of commendation bars (in phantom view) mounted on the frame of this invention.
Figure 4:
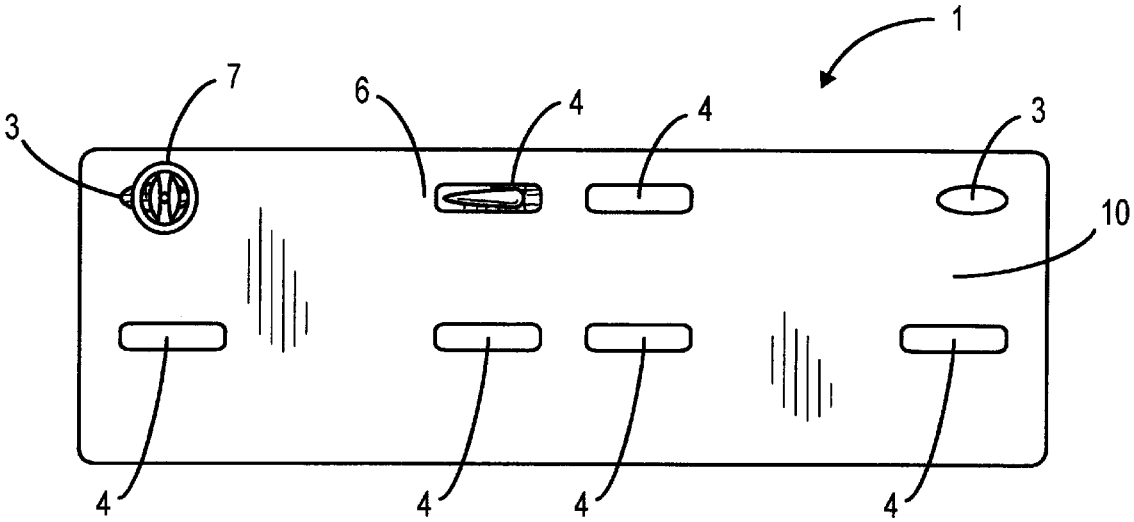
FIG. 4 is plan view of the backside of the frame showing one commendation bar in position to be mounted on the frame.

Extending through the plate 10 of the mounting device 1 are a number of holes or openings. There are two preferably oval openings 3, and a number of oblong openings 4. The number of openings depends on the number of commendation bars the mounting device 1 is designed to hold. The oval openings 3 are placed in the upper left and right hand corners of the mounting device 1. As shown in FIGS. 1, 2, and 4, a pair of oblong openings 4 are offset on either side of the midpoint of the major side. The oblong openings 4 are placed directly across from the oval openings 3 along the flange bordering the upper major side.

As shown in FIGS. 1, 2, 3 and 4, the commendation bar 5 is a generally rectangular bar which is smaller then the mounting device 1. The width of each commendation bar 5 is about half the width of the mounting device 1. Likewise, the height of each commendation bar is about half the height of mounting device 1. The commendation bar 5 is roughly as thick as the sidewall 2 which surrounds the periphery of the plate 10. Once all the possible commendation bars 5 are attached to the mounting device 1, the commendation bars 5 and the mounting device 1 should appear as one cohesive unit.

The front face of each commendation bar 5 is colored to signify the nature of achievement that is being rewarded. For example, the color could signify that the officer has acted bravely, or has achieved success on the firing range. The back face 11 of each commendation bar, has a pair of pins which protrude perpendicularly from the backside of the commendation bar.

A commendation bar 5 can be attached to the mounting device 1, by aligning the backside 11 of the commendation bar in face-to-face registration with the front surface of plate 10 of the mounting device 1. When so oriented, the colored front of the commendation bar 5 is facing outward, and that the major and minor sides of the commendation bar run parallel with portions of the peripheral side wall 2 running along the major and minor sides of the mounting device 1. Each pin 7 projects through one of the openings 3 or 4 in the plate 2.

The commendation bar 5 is secured to the mounting device 1 by using glue or some other suitable adhesive. Each pin 6 that interfaces with an oblong opening 4 is bent so that the tip of the pin 6 bends back into the oblong opening 4. Alternatively, the pin 6 can be cut off of the commendation bar 5. Two pins 9 will not be bent over into the oblong opening 4 or snipped off the commendation bar 5. To ensure that the mounting device 1 does not pivot on the uniform, the two pins 9 closest to the upper corners of the mounting device are not bent over. These pins pierce the fabric of the uniform to couple the frame and commendation bars to the uniform.

Figure 5:
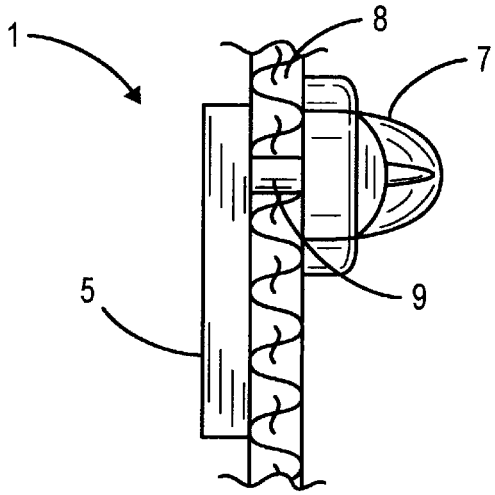
FIG. 5 is an enlarged cross-sectional view showing the frame and badges mounted on a garment.

Referring to FIG. 5, the mounting device 1 is illustrated in a position on a uniform 8. After the commendation bars have been coupled to the mounting device 1, any protruding pins 9 that have not been bent over or snipped off, penetrate the fabric of the officer's uniform 8. The pins 9 are then inserted into cooperating releasable clasps 7 which clamp the pins on the inside of the uniform 8.

Figure 6:
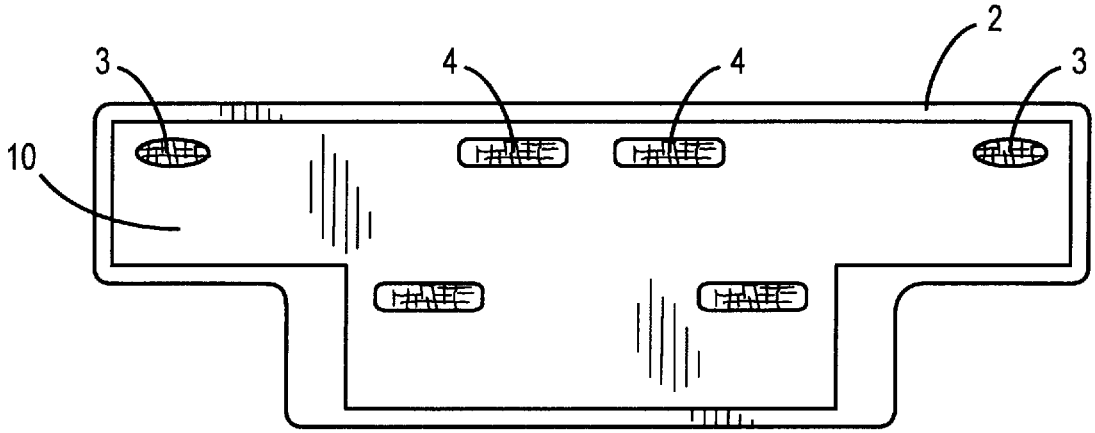
FIG. 6 is a plain view of an alternative embodiment of the invention which holds three commendation bars.
Figure 7:
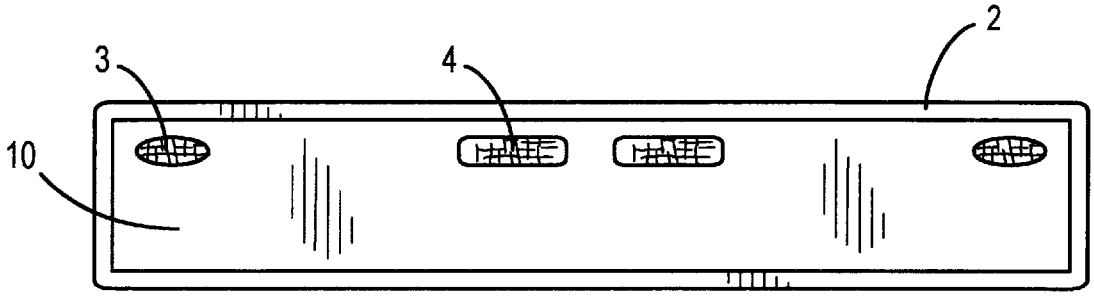
FIG. 7 is a plain view of a alternative embodiment of the invention which holds two commendation bars.

FIG. 6 shows an alternative embodiment designed to accommodate three commendation bars rather than four commendation bars accommodated by the embodiment shown in FIGS. 1–5. The embodiment shown in FIG. 6 has a plate 10, peripheral sidewall 2, and oval openings 3, and oblong openings 4. The only differences between the embodiments relate to the overall shape and number of hole. Those skilled in the art will recognize that the shape and number of holes can be readily modified to accommodate different numbers of commendation bars and different shaped commendation bars without deviating from the invention.

What is claimed is:

1. A frame for mounting a plurality of commendation bars onto a uniform, each of the plurality of commendation bars having a flat, substantially rectangular front face, and a back face with pins protruding perpendicularly therefrom, the frame comprising a substantially flat plate with a peripheral side wall projecting forwardly from the plate, and oval openings through the flat plate for receiving pins protruding from the back face of the commendation bars, wherein the commendation bars are placed flush against the plate so that the pins are received by the openings such that the tips of the pins can be bent back into the opening or snipped off and the commendation bars are secured to the plate using a suitable adhesive.

2. A frame for mounting a plurality of commendation bars onto a uniform, each of the plurality of commendation bars having a flat, substantially rectangular front face, and a back face with pins protruding perpendicularly therefrom, the frame comprising a substantially flat plate with a peripheral side wall projecting forwardly from the plate, and oval openings through the flat plate for receiving pins protruding from the back face of the commendation bars, wherein the commendation bars are placed flush against the plate so that the pins are received by the openings such that the pins not bent or snipped are protruding past the plate to penetrate the uniform and are received by cooperating releasable clasps which clamp the pins on the inside of the uniform to hold the frame and commendation bars in place on the uniform.

* * * * *